US005828284A

United States Patent [19]

Huang

[11] Patent Number: 5,828,284

[45] Date of Patent: Oct. 27, 1998

[54] CIRCUIT OVERLOAD PROTECTIVE DEVICE

[76] Inventor: Albert Huang, No. 210-1, Hsing Nueng Rd., Tou Liu City, Yunlin Hsien, Taiwan

[21] Appl. No.: 985,311

[22] Filed: Dec. 4, 1997

[51] Int. Cl.[6] ..... H01H 37/02; H01H 37/32; H01H 37/46; H01H 37/52

[52] U.S. Cl. ..... 337/37; 337/333; 337/39; 337/59; 337/85; 337/112; 337/113

[58] Field of Search ..... 337/333, 37, 39, 337/59, 85, 337, 312, 1, 3, 12–14, 16, 62, 66, 68, 72, 75, 79, 89, 101, 111–113

[56] References Cited

U.S. PATENT DOCUMENTS 5,262,748 11/1993 Tsung-Mou ..... 337/66

5,694,106 12/1997 Wang ..... 337/79

*Primary Examiner*—Leo P. Picard
*Assistant Examiner*—Anatoly Vortman
*Attorney, Agent, or Firm*—Rosenberg, Klein & Bilker

[57] ABSTRACT

A circuit overload protective device includes a body having a button pivotally disposed thereto and a bimetallic strip disposed thereto which has a first contact point disengagably contacting a second contact point on the body. A first member and a second member are respectively connected to an underside of the button, wherein the first member has a leg extending therefrom so as to be shifted into a curved recess defined in a first inner side of the body when the bimetallic strip is deformed, and the second member has a distal end thereof connected to the first contact point. A third member is disposed to a second inner side of the body and a spring is biasedly connected between the first member and the third member.

7 Claims, 4 Drawing Sheets

CIRCUIT OVERLOAD PROTECTIVE DEVICE

BACKGROUND OF THE INVENTION

1. Field of the Invention

The present invention relates to a circuit overload protective device for electrical facilities and, more particularly, to an improved circuit overload protective device having a simple structure.

2. Brief Description of the Prior Art

Overload protective devices are used to protect electrical facilities from being damaged by overloaded current. Generally, the circuit overload protective device includes a bimetallic strip which has one end thereof contacting a contact point so as to define a circuit. The bimetallic strip is deformed when a temperature thereof is changed due to an overloaded current so as to disengage the end from the contact point. The device typically includes a complicated structure so as to position the bimetallic strip and related parts cooperated with the bimetallic strip. The complicated structure of the circuit overload protective device results in a high manufacturing cost. Furthermore, a button is pivotally disposed to the circuit overload protective device and has a stud extending downwardly therefrom so that when the bimetallic strip is deformed, the stud is pushed and shifted to actuate the button. However, the stud is not well positioned when the bimetallic strip distorts so that misactions of the stud could happen.

The present invention intends to provide an improved structure of a circuit overload protective device to mitigate and/or obviate the above-mentioned problems.

SUMMARY OF THE INVENTION

The present invention provides a circuit overload protective device which comprises a body having a bottom with a first wall and a second wall respectively extending from two ends of the bottom. The first wall has a curved recess defined in an inner side thereof and the second wall has a support member extending laterally from an inner side thereof. At least two terminals extend downwardly from an underside of the bottom on which a first contact point is disposed and connected to one of the terminals.

A bimetallic strip has a first end thereof fixedly connected to the second wall and a second end thereof with a second contact point disposed thereto which disengagably contacts the first contact point. A button is pivotally disposed to a top of the body.

A first member and a second member are respectively connected to one of two ends of the button. The first member has a leg extending inclinedly and downwardly therefrom and the second member has a distal end thereof connected to the second contact point.

A third member is connected to the support member and a spring is biasedly connected between the first and the third member. When the bimetallic strip is deformed, the second contact point is raised due to the deformation of the bimetallic strip so as to lift the first and the second member and the leg slides into the curved recess.

It is an object of the present invention to provide a circuit overload protective device having a curved recess so as to receive a first member when a bimetallic strip is deformed.

It is another object of the present invention to provide a circuit overload protective device wherein a button is automatically switched when the current is stable again.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
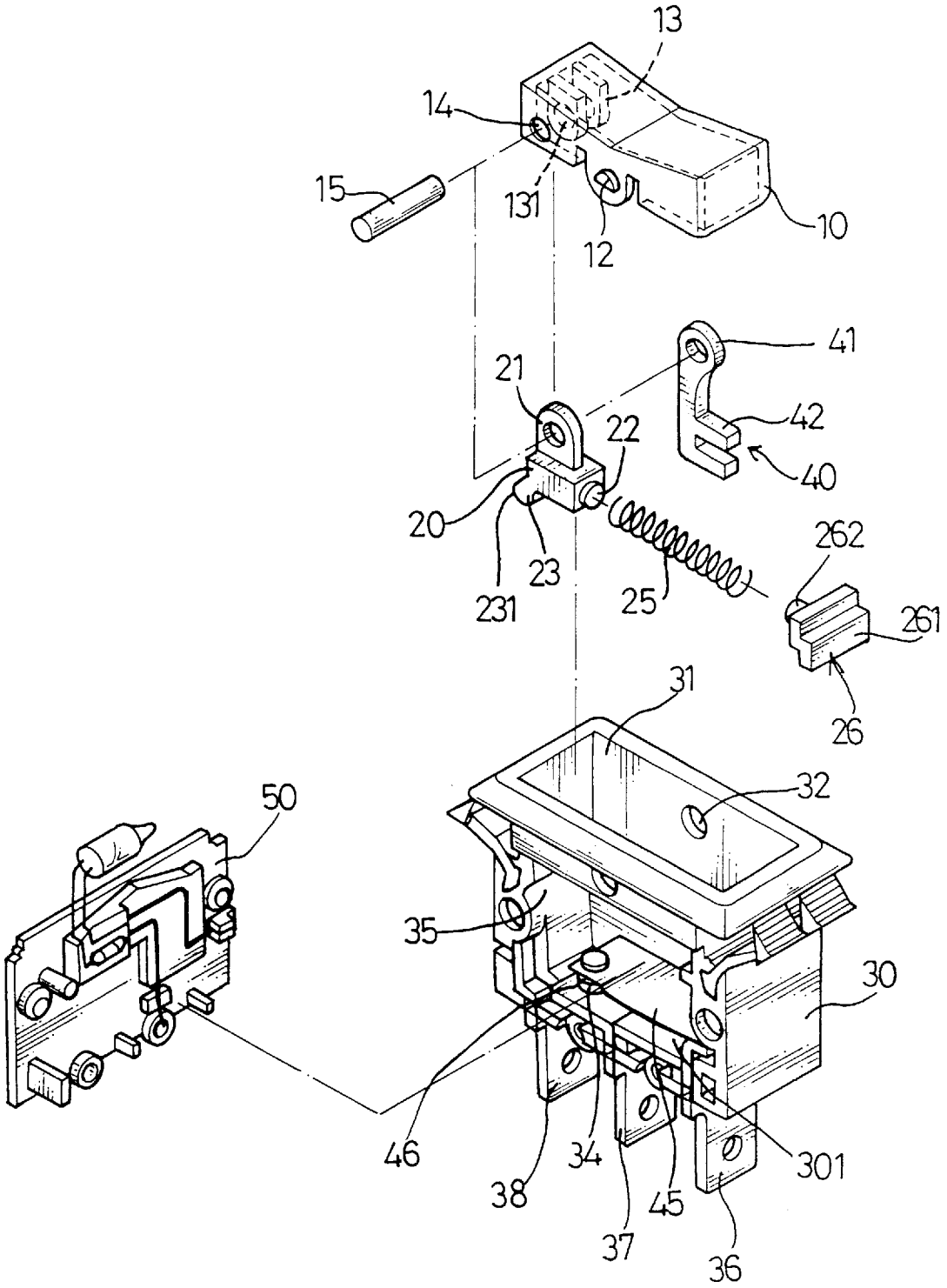
FIG. 1 is an exploded view of a circuit overload protective device in accordance with the present invention.
Figure 2:
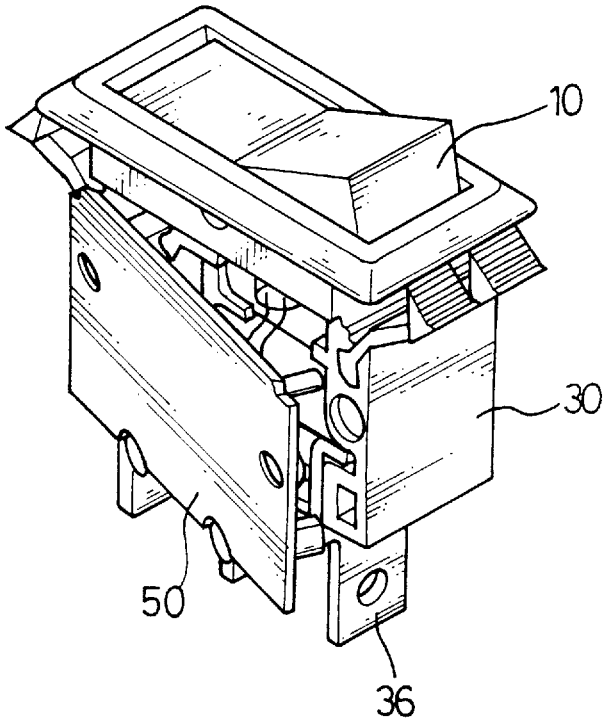
FIG. 2 is a perspective view of the circuit overload protective device wherein a front wall is opened slightly so as to illustrate an interior of the device.
Figure 3:
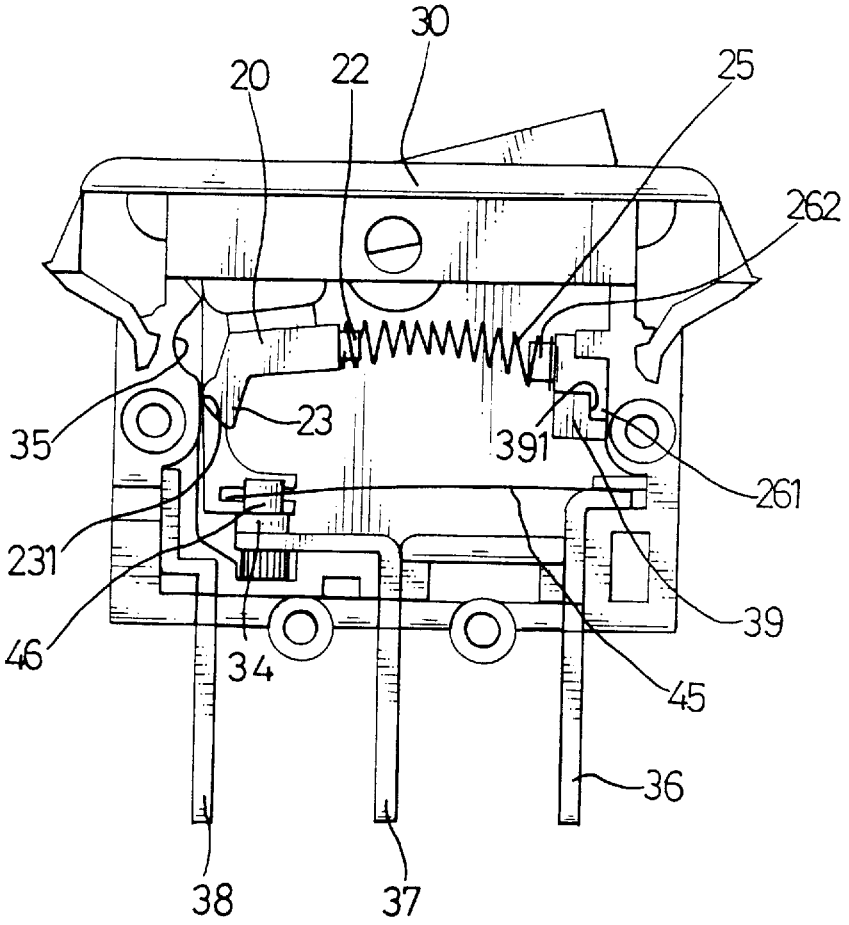
FIG. 3 is a side elevational view, partly in section, of the device when a bimetallic strip is not deformed yet.

Referring to the drawings and initially to FIGS. 1 through 3, a circuit overload protective device in accordance with the present invention generally includes a body 30 having a bottom 301 with a first wall and a second wall respectively extending from two ends of the bottom 301, a rear wall 31 and a front wall 50 which can be connected to the body 30. The first wall has a curved recess 35 defined in an inner side thereof and the second wall has a support member 39 extending laterally from an inner side thereof, wherein the support member 39 defines a recess 391 between it and the second wall. Three terminals 36, 37 and 38 extend downwardly from an underside of the bottom 301, a first contact point 34 being disposed to the terminal 37.

A bimetallic strip 45 has a first end thereof fixedly connected to the second wall and a second end (free end) having a second contact point 46 disposed thereto. The second contact point 46 disengagably contacts the first contact point 34. A button 10 is pivotally disposed to a top of the body 30 with two protrusions 12 (only one is shown) extending through two holes 32 respectively defined through the front and the rear wall 50, 31. The button 10 has a hole 14 defined laterally through one of two ends of a skirt portion thereof and two lugs 13 extending from an underside thereof. Each of the lugs 13 has a second hole 131 defined therethrough which is in alignment with the hole 14.

A first member 20 has a leg 23 extending inclinedly and downwardly therefrom and an ear 21 extending upwardly therefrom which has an aperture defined therethrough so as to be inserted between one of the two lugs 13 and the skirt portion of the button 10. The leg 23 has a curved outer surface 231 so that it can easily be shifted into the curved recess 35 of the body 30 when a circuit overload occurs. A second member 40 has an ear 41 extending therefrom and an aperture defined through the ear 41. The ear 41 is inserted between the two lugs 13 and a pin 15 extends through the hole 14, the two ears 21, 41 and the two lugs 13 to connect the first member and the second member 20, 40 to the button 10. A distal end of the second member 40, which has a fork portion 42 formed therein, is fixedly connected to the second contact point 46.

A third member 26 has an insert portion 261 extending therefrom so as to be received in the recess 391. Each of the first member 20 and the third member 26 has a boss 22/262 extending therefrom. A spring 25 is positioned between the two bosses 22, 262 and biasedly connected between the first member 20 and the third member 26.

Figure 4:
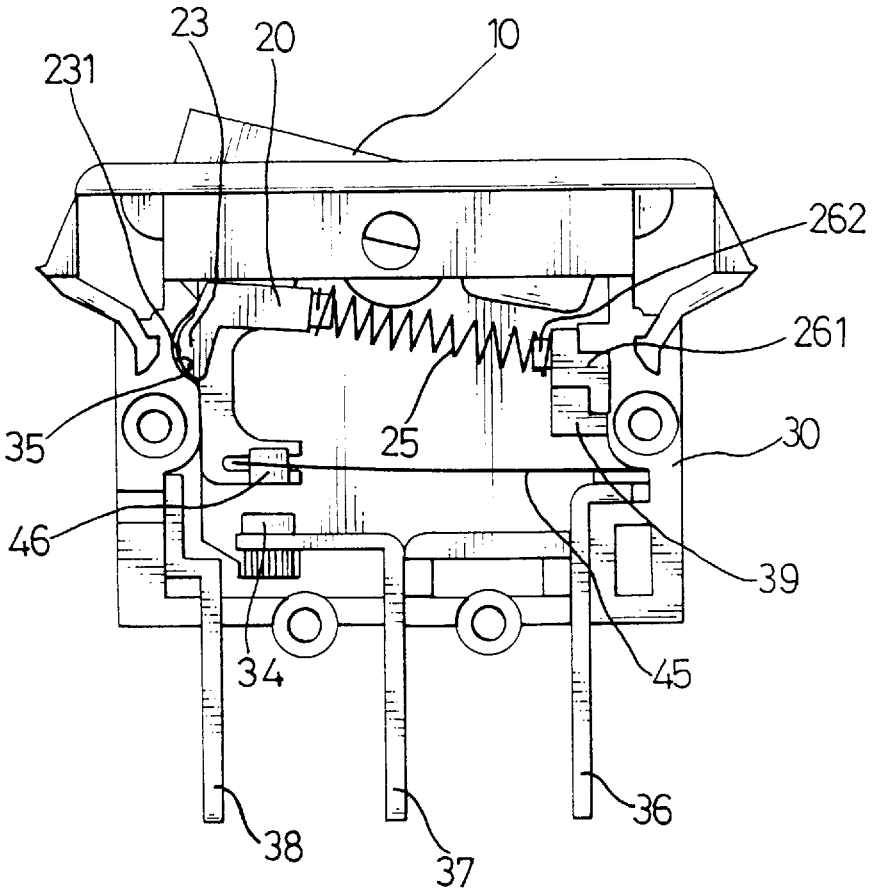
FIG. 4 is a side elevational view, partly in section, of the device when the bimetallic strip is deformed to break the circuit.

When the first and the second contact points 34, 46 are in contact with each other, a circuit is completed. When a circuit overload current occurs, referring to FIG. 4, the bimetallic strip 45 is deformed so that the second contact point 46 is raised to lift the first and the second member 20, 40, after which the leg 23 then slides into the curved recess 35. The leg 23 received in the curved recess 35 facilitates positioning of the button 10. Once the current is stable again, the bimetallic strip 45 is returned to its original status and pulls the second contact point 46 contacts the first contact point 34.

Although the invention has been explained in relation to its preferred embodiment, it is to be understood that many other possible modifications and variations can be made without departing from the spirit and scope of the invention as hereinafter claimed.

What is claimed is:

1. A circuit overload protective device comprising:

a body having a bottom with a first wall and a second wall respectively extending from two ends of said bottom, said first wall having a curved recess defined in an inner side thereof and said second wall having a support member extending laterally from an inner side thereof, at least two terminals extending downwardly from an underside of said bottom, a first contact point disposed to one of said terminals;

a bimetallic strip having a first end thereof fixedly connected to said second wall and a second end thereof with a second contact point disposed thereto, said second contact point disengagably contacting said first contact point;

a button pivotally disposed to a top of said body;

a first member and a second member respectively connected to one of two ends of said button, said first member having a leg extending inclinedly and downwardly therefrom and said second member having a distal end thereof connected to said second contact point, and a third member connected to said support member and a spring biasedly connected between said first and said third member.

2. The circuit overload protective device as claimed in claim 1 wherein said button has a hole defined laterally through one of two ends of a skirt portion thereof and a pin extends through said hole and said first and said second member.

3. The circuit overload protective device as claimed in claim 2 wherein said button has two lugs extending from an underside thereof and each of said lugs having a second hole defined therethrough which is in alignment with said hole.

4. The circuit overload protective device as claimed in claim 3 wherein said first and said second member each have an ear extending therefrom, each of said two ears having an aperture defined therethrough and said ear of said second member being inserted between said two lugs and said ear of said first member being inserted between one of said two lugs and the skirt portion of said button.

5. The circuit overload protective device as claimed in claim 1 wherein said support member has a recess defined between said second wall and said support member, said third member having an insert portion extending therefrom so as to be received in said recess.

6. The circuit overload protective device as claimed in claim 1 wherein said second contact point is raised so as to lift said first member and said second member and said leg slides into the curved recess when said bimetallic strip is deformed.

7. The circuit overload protective device as claimed in claim 6 wherein said leg has a curved outer surface.

* * * * *